United States Patent [19]

Baker

[11] 4,193,596

[45] Mar. 18, 1980

[54] POOL BALL SEPARATOR

[76] Inventor: Raymond J. Baker, Corner of Palamino Dr. & Matson Rd., Merlin, Joseline County, Oreg. 97532

[21] Appl. No.: 918,340

[22] Filed: Jun. 23, 1978

[51] Int. Cl.[2] ..... A63D 15/00

[52] U.S. Cl. ..... 273/11 C; 209/636; 209/652

[58] Field of Search ..... 273/11 R, 11 C, 14, 273/2, 54 R, 59 R, 59 A, 59 B; 209/606, 636, 652

[56] References Cited

U.S. PATENT DOCUMENTS

| | | | |
|---|---|---|---|
| 3,362,717 | 6/1968 | Feddick | 273/71 C |
| 3,797,627 | 3/1974 | Baker | 273/11 C |
| 4,015,845 | 4/1977 | Sines | 273/11 C |
| 4,116,435 | 9/1978 | Sines | 273/11 R |

*Primary Examiner*—Richard C. Pinkham
*Assistant Examiner*—T. Brown
*Attorney, Agent, or Firm*—William H. Maxwell

[57] ABSTRACT

A ball separator for pool tables that strikes only the "Q" ball as it passes through the ball run which directs playing balls to one crib and the "Q" ball to a separate crib, utilizing a magnetic "Q" ball and a magnet pendulum attracted thereby to strike the same as said ball passes along the ball run, thereby diverting the "Q" ball into a return run to a separate crib.

12 Claims, 4 Drawing Figures

POOL BALL SEPARATOR

BACKGROUND

Pool tables used in commercial establishments are often coin operated, in which case it is necessary to separate the playing balls from the "Q" ball, the former being collected when pocketed and the latter being returned for reuse as the game progresses. Heretofore, the "Q" ball has been made of slightly larger diameter than the numbered playing balls and engageable with a ball run obstruction so as to be diverted into a separate crib, or the "Q" ball has been made with magnetic qualities so as to be attracted into the diverting ball run. The advantage of the magnetic "Q" ball is its same size as the playing balls, however difficulties arise in assurance that it will always be attracted into the diverting ball run. That is, the diversion by stationary magnet means of the prior art is not altogether satisfactory, it being an object of this invention to provide a dynamic magnet pendulum means which ensures diversion of the "Q" ball into a ball run separate from the numbered playing balls.

"Q" ball separators are provided in pool tables, especially coin operated pool tables, to return the "Q" ball to its crib each time it is pocketed, and to pass all pocketed playing balls into a terminous of the ball run. Accordingly, there are ball runs for each table pocket converging together, into a center ball run of which the separator herein disclosed is a part or extension. In practice, the separator is a right angular extension of the center ball run at one end of the table and which diverts the "Q" ball into a return run extending to the other end of the table where the "Q" ball is to be retrieved for replay when pocketed. Accordingly, it is an object of this invention to strike only the "Q" ball as it passes through the separator and so that it is diverted into said return run. With the present invention, the "Q" ball is magnetic and attracts a magnet which operates as a pendulum-hammer to strike the ball into the diverting return run.

SUMMARY OF INVENTION

This invention relates particularly to pool tables as they are used in commercial establishments where persons deposit coins therein for the privilege of playing the facilities of the pool tables. The table can vary in size and in the arrangement of pockets, and generally a table involves a felt covered slate 10 supported by legs 11 and having side and end rails 12 and 13. As shown, there are corner pockets 14 and side pockets 15, and all of which open into ball runs 16 that channel the pocketed balls to a terminus which is disposed adjacent the front end rail 13. The slate supporting table structure has substantial depth as is indicated and the pocketed balls are channeled by a center run 16 toward the front end rail 13 where they are diverted laterally by a "Q" ball separator S which passes the playing balls onto the elevated end of the slide tray X and which diverts the "Q" ball to a return run 17 and to a crib 18 at the opposite rear end rail 12. A drawer D closes the front end rail 13 and provides for support of a coin control C and coin chute, and primary and secondary anti-cheat means Y and Z are associated with the slide tray X, the said primary means Y being operated by the release of said coin control C to shift the slide tray X and simultaneously drop all balls thereon at the ball run terminus established thereby. The aforesaid drawer D, coin control C, and slide tray X with anti-cheat means Y and Z are all the subject matter of U.S. Pat. No. 3,797,627 entitled Pool table ball dispenser, issued Mar. 9, 1974.

DRAWINGS

The various objects and features of this invention will be fully understood from the following detailed description of the typical preferred form and application thereof, throughout which description reference is made to the accompanying drawings, in which.

Figure 1:
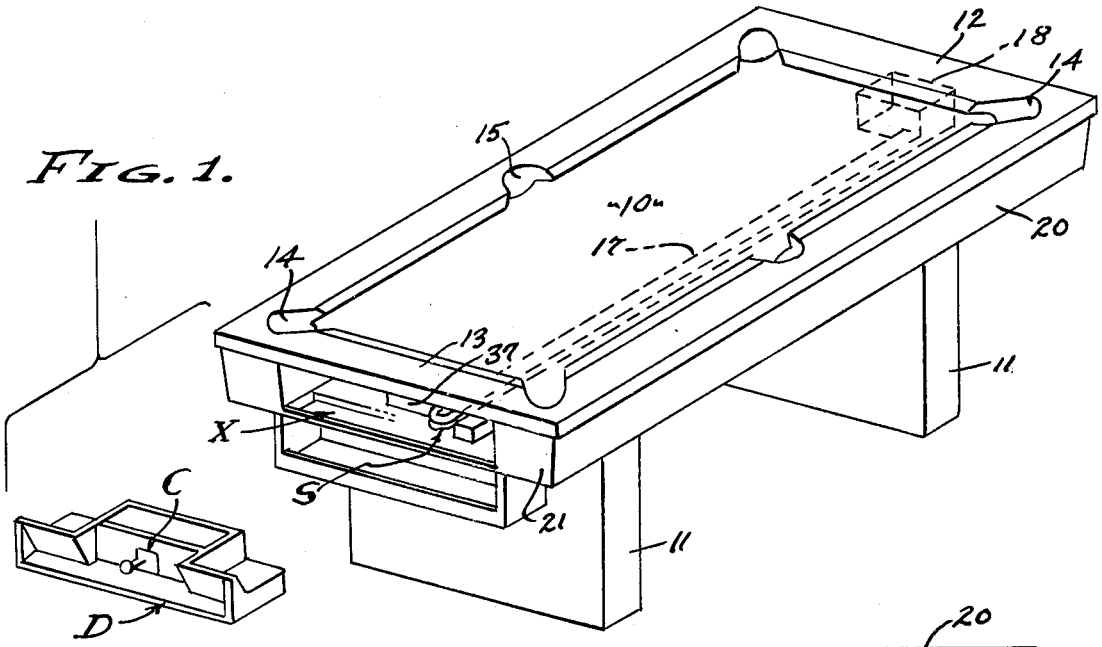
FIG. 1 is an exploded perspective view showing the drawer of the table removed so as to expose the separator pendulum of the present invention.
Figure 2:
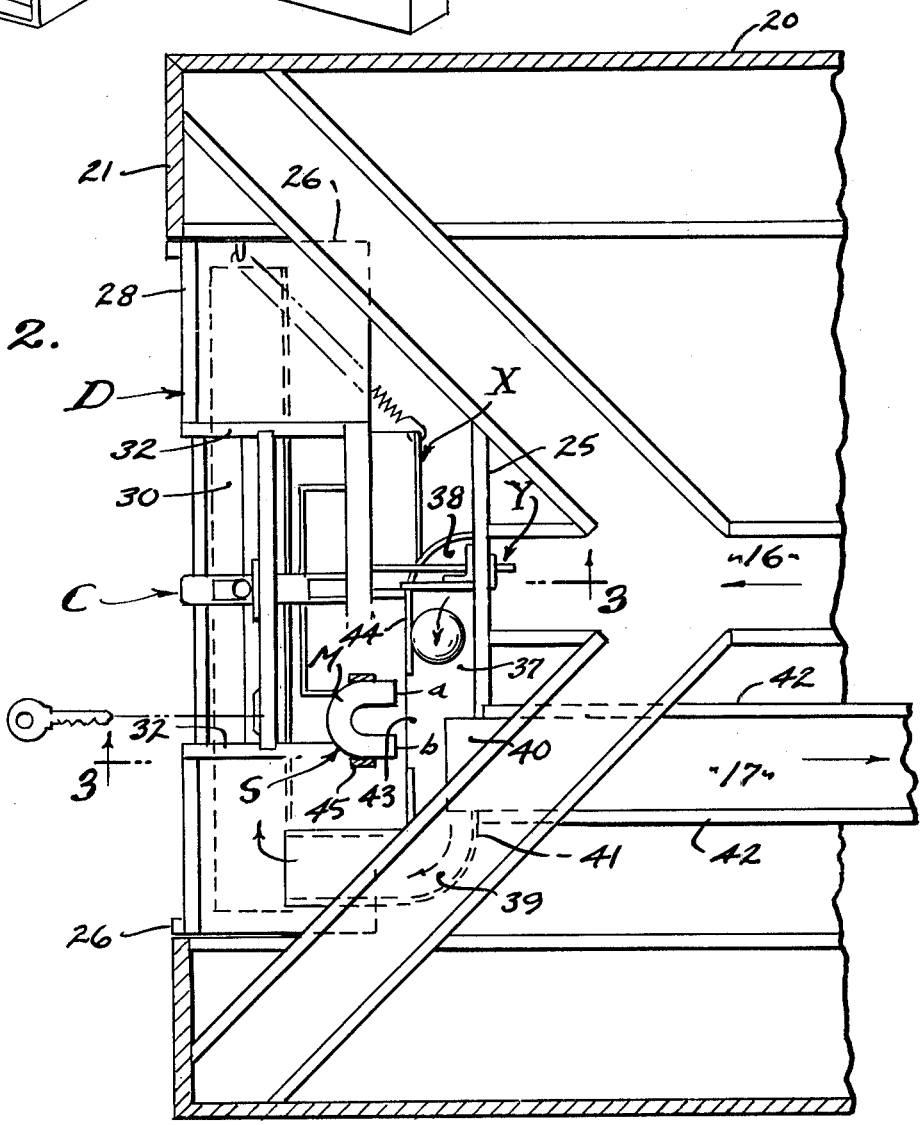
FIG. 2 is an enlarged plan view showing the combined relationship of the coin controlled pool table drawer and separator pendulum means of the present invention.
Figure 3:
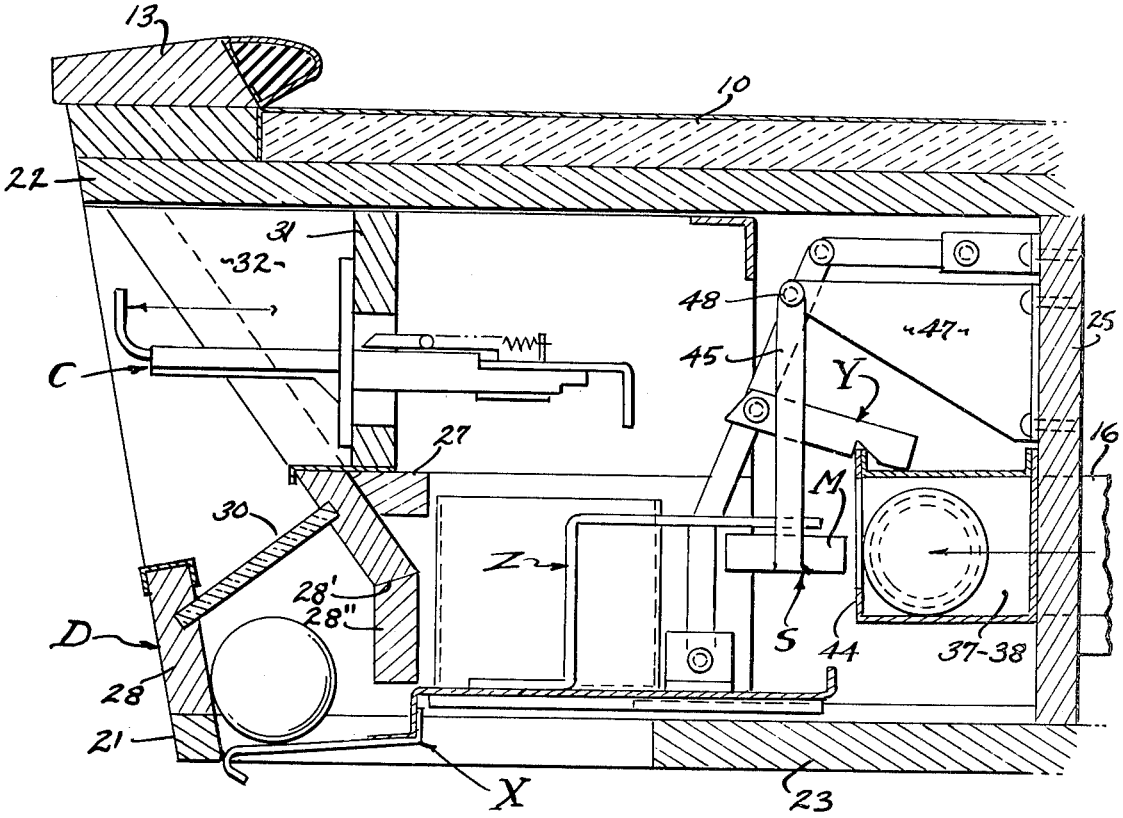
FIG. 3 is an enlarged sectional view taken substantially as indicated by line 3—3 on FIG. 2, at the center ball run.
Figure 4:
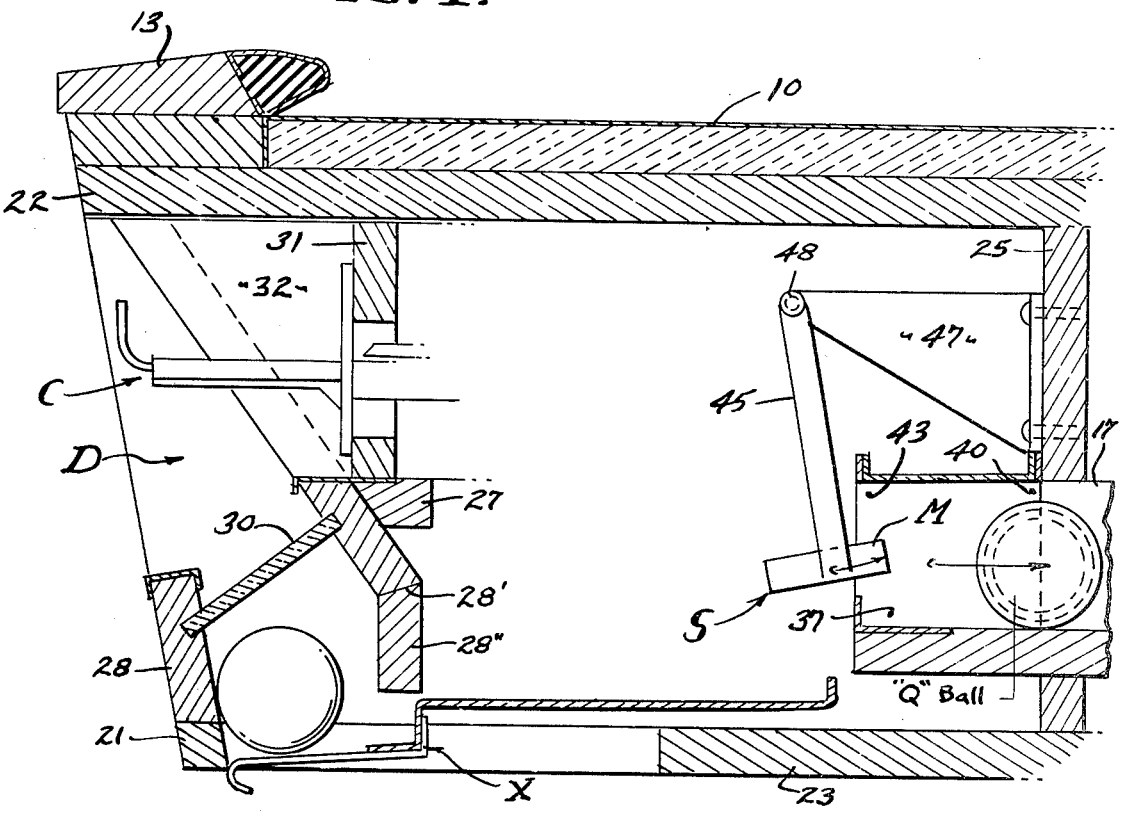

And, FIG. 4 is an enlarged sectional view similar to FIG. 3, at the return ball run.

PREFERRED EMBODIMENT

The supporting structure for the felt covered slate 10 is a rigid box construction having side and end walls 20 and 21 that extend between upper and lower platform and deck members 22 and 23. The members 22 and 23 are horizontally disposed spaced and parallel members, there being additional interior stiffeners extending both longitudinally and transversely as circumstances require. For example, there is a transverse vertically disposed bulkhead stiffener 25 that is spaced from the front end wall 21 to form a chamber. The front end wall 21 is interrupted by the drawer D which has a front panel 28 that replaces the greater portion of said front wall. As shown, the drawer D rests upon the deck 23 with its front panel 28 extending to the platform 22. The felt covered slate 10 is supported by and coextensively overlies the said platform member 22.

The drawer D is removable from the table structure and has vertically disposed side cheek members 26 that carry a shelf 27 to which the upper portion of the front panel 28 is attached with its lowermost edge 28' rearwardly offset from the front end wall 21. A ball guide 28'' depends from the edge 28' parallel with front panel 28 and spaced therefrom to form a channel. As shown, a picture window 30 occupies the offset opening between said upper and lower portions of the front panel 28 and overlying said channel, wherein the pocketed playing balls are inaccessibly visible. The coin control C is carried by the drawer D, by means of a removable panel section 31 that interrupts the front panel 28 and replaces the center portion thereof between spaced inner cheeks 32.

In accordance with this invention the "Q" ball separator S is provided to return the "Q" ball each time it is pocketed, and to pass all pocketed playing balls into the terminus of the ball runs. The ball run terminus is established by the slide tray X with its elevated end at one side of and to extend beneath the picture window 30, and therefore the separator S diverts the "Q" ball from and directs all playing balls to the said elevated end of the slide tray. As is shown, the ball separator S is a lateral continuation 37 of the center ball run 16, with a right angular entrance 38 and with a right angular exit 39. The "Q" ball is the same in diameter as the playing balls and separator S is characterized by a swinging magnet M exposed to the lateral continuation 37 of the center ball run. It is an object to return the "Q" ball to the crib 18 at the table end opposite the playing ball terminus, and it is to this end that the separator S comprises a lateral run 37 with diversion of the "Q" ball into the return run 17 that extends therefrom to the far end of the table. It will be observed therefore, that the separator S is advantageously combined with the aforesaid drawer D, coin control C, and slide tray X with anti-cheat means Y and Z.

Referring now to the "Q" ball, its diameter is the same as the playing balls, its surface being a white unnumbered shell coextensively surrounding a sphere of iron, a magnetic ball. The iron sphere has a wall thickness that determines the ball weight, so that the "Q" ball has the proper inertia qualities. In practice, any such ball having substantial iron mass immediately underlying its periphery is suitable.

Referring now to the separator S, the lateral continuation 37 of the center ball run 16 is disposed between the back of the slide tray X and the bulkhead stiffener 25. It is to be understood that the ball runs 16 and 17 and said continuation 37 thereof are declined channels in which pocketed balls gravitate to a crib, the separator diverting "Q" balls into the run 17 to crib 18. As shown, the return run 17 opens from the back side of the lateral run 37, there being an opening 40 in the back side rail 41 of the run 37, said opening being defined by the side rails 42 of the run 17. Opposite the run opening 40 and offset therefrom in the direction toward the approaching balls, there is an opening 43 through which the swinging magnet M of the present invention operates to strike passing "Q" balls. That is, the magnet position is upgrade from the run opening 40 so that the forward momentum of the "Q" ball is accounted for in making its turn into the return run 17. The bottom of the lateral run 37 is slanted toward the front rail 44, whereby the "Q" ball will ride upon said rail so as to be proximate to said magnet for its attraction thereto. Inertia of the balls tends to carry them by the openings 40 and 43, assuring that the playing balls go forward to their intended terminus.

In accordance with this invention, the magnet M depends as a pendulum from an arm or arms 45 pivoted above the lateral ball run 37, the magnet being balanced at the lower end of the arm with at least one and preferably both pole faces at the opening 43 and parallel with the rail 44. A feature is the set-back of the pole faces from the rail 44 surface which guides the perimeter of the "Q" ball, whereby attraction of the magnet M to the "Q" ball provides acceleration of the magnet M which causes it to strike the ball.

The magnet arms 45 are supported by spaced standards 47 between which there is a pivot pin 48. The opening 43 is of substantial width and the magnet M is U-shaped with its opposite pole faces exposed through the opening. Note particularly that the opposite poles a and b are substantially spaced longitudinally of the ball run 37 to the end that they are sequentially attracted toward the magnetic "Q" ball. Accordingly, the pole face a is first attracted causing the pendulum magnet M to start its swing, and as the "Q" ball moves forwardly the magnet M is accelerated into striking engagement therewith by the pole face b which diverts the "Q" ball into the opening 40. Note that the slant of return run 17 is notched into and enters the bottom of the lateral run 37 (see FIG. 4) but not to interfere with continued forward motion of the playing balls which are not attractive to the magnet M.

From the foregoing it will be seen that a very simple and very effective separator is provided for ensuring the redirection of magnetic "Q" balls into a crib separate from the playing ball crib, especially in a coin operated pool table having a removable coin controlled drawer.

Having described only a typical preferred form and application of my invention, I do not wish to be limited or restricted to the specific details herein set forth, but wish to reserve to myself any modifications or variations that may appear to those skilled in the art as set forth within the limits of the following claims:

I claim:

1. A pool table ball separator for separating a magnetic "Q" ball from non-magnetic playing balls including, a pool table having pockets, a magnetic "Q" ball, a plurality of non-magnetic playing balls, a playing ball and a "Q" ball crib, a ball run leading from each of said table pockets to said playing ball crib, a return ball run opening into and leading from one side of said first mentioned ball run to said "Q" ball crib, and separator means comprising a free swinging magnet positioned on the other side of said first mentioned ball run and adjacent said opening into said first mentioned ball run for attraction to only said magnetic "Q" ball moving along said first mentioned ball run and to strike the same and direct it into said return ball run opening whereby it will roll along said return ball run and into said "Q" ball crib.

2. The "Q" ball separator as set forth in claim 1, wherein said free swinging magnet is spaced from and positioned to swing substantially normal to the path of said balls rolling along said first mentioned ball run such that upon said attraction to said "Q" ball rolling along said path said magnet will swing and strike said "Q" ball and cause it to be directed into said return ball run opening.

3. The "Q" ball separator as set forth in claim 1, wherein said return ball run has opposite side rails guiding said balls therethrough, and wherein said return ball run opening extends through one of said side rails, said swinging magnet having at least one pole face exposed to passing balls through an opening in the other of said side rails opposite the return ball run opening.

4. The "Q" ball separator as set forth in claim 1, wherein said return ball run has opposite side rails for guiding said balls therethrough, and wherein said return ball run opening extends through one of said side rails, said swinging magnet having at least one pole face exposed to passing balls through an opening in the other of said side rails opposite said return ball run opening and being spaced from and positioned to swing substantially normal to the path of said balls rolling along said first mentioned ball run such that upon said attraction to said "Q" ball rolling along said path said magnet will swing and strike said "Q" ball and cause it to be directed into said return ball run opening.

5. The "Q" ball separator as set forth in claim 1, wherein said return ball run has opposite side rails for guiding said balls therethrough, and wherein said return ball run opening extends through one of said side rails, said swinging magnet having a pair of pole faces spaced longitudinally of and substantially normal to the longitudinal axis of said first mentioned ball run and exposed sequentially to passing balls through an opening in the other of said side rails opposite the return ball run opening.

6. The "Q" ball separator as set forth in claim 1, wherein said return ball run has opposite side rails guiding said balls therethrough, and wherein said return ball run opening extends through one of said side rails, said swinging magnet having a pair of pole faces spaced longitudinally of and substantially normal to the longitudinal axis of said first mentioned ball run and exposed sequentially to passing balls through an opening in the other of said side rails opposite said return ball run opening and being spaced from and positioned to swing substantially normal to the path of said balls rolling along said first mentioned ball run such that upon said attraction to said "Q" ball rolling along said path said magnet will swing and strike said "Q" ball and cause it to be directed into said return ball run opening.

7. The "Q" ball separator as set forth in claim 1, wherein said swinging magnet is carried by an arm depending from a pivot disposed above said first mentioned ball run on an axis parallel therewith.

8. The "Q" ball separator as set forth in claim 1, wherein said swinging magnet is carried by an arm depending from a pivot disposed above said first mentioned ball run on an axis parallel therewith, and wherein said free swinging magnet is spaced from and positioned to swing substantially normal to the path of said balls rolling along said first mentioned ball run such that upon said attraction to said "Q" ball rolling along said path said magnet will swing and strike said "Q" ball and cause it to be directed into said return ball run opening.

9. The "Q" ball separator as set forth in claim 1, wherein said swinging magnet is carried by an arm depending from a pivot disposed above said first mentioned ball run on an axis parallel therewith, wherein the return ball run has opposite side rails guiding the balls therethrough, and wherein said return ball run opening extends through one of said rails, said swinging magnet having at least one pole face exposed to passing balls through an opening in the other of said side rails opposite the return ball run opening.

10. The "Q" ball separator as set forth in claim 1, wherein said swinging magnet is carried by an arm depending from a pivot disposed above said first mentioned ball run on an axis parallel therewith, wherein the return ball run has opposite side rails guiding the balls therethrough, and wherein said return ball run opening extends through one of said side rails, said swinging magnet having at least one pole face exposed to passing balls through an opening in the other of said side rails opposite the return ball run opening and spaced from and positioned to swing substantially normal to the path of said balls rolling along said first mentioned ball run such that upon said attraction to said "Q" ball rolling along said path said magnet will swing and strike said "Q" ball and cause it to be directed into said return ball run opening.

11. The "Q" ball separator as set forth in claim 1, wherein said swinging magnet is carried by an arm depending from a pivot disposed above said first mentioned ball run on an axis parallel therewith, wherein the return ball run has opposite side rails guiding the balls therethrough, and wherein said return ball run opening extends through one of said side rails, said swinging magnet having a pair of pole faces spaced longitudinally of and substantially normal to the longitudinal axis of said first mentioned ball run and exposed sequentially to passing balls through an opening in the other of said side rails opposite the return ball run opening.

12. The "Q" ball separator as set forth in claim 1, wherein said swinging magnet is carried by an arm depending from a pivot disposed above said first mentioned ball run on an axis parallel therewith, wherein the return ball run has opposite side rails guiding the balls therethrough, and wherein said return ball run opening extends through one of said side rails, said swinging magnet having a pair of pole faces spaced longitudinally of the first mentioned ball run and exposed sequentially to passing balls through an opening in the other of said side rails opposite the return ball run opening and being spaced from and positioned to swing substantially normal to the path of said balls rolling along said first mentioned ball run such that upon said attraction to said "Q" ball rolling along said path said magnet will swing and strike said "Q" ball and cause it to be directed into said return ball run opening.

* * * * *